US009164446B2

(12) United States Patent
Kanematsu

(10) Patent No.: US 9,164,446 B2
(45) Date of Patent: Oct. 20, 2015

(54) FIXING DEVICE AND IMAGE FORMING APPARATUS

(71) Applicant: KYOCERA Document Solutions Inc., Osaka (JP)

(72) Inventor: Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/510,346

(22) Filed: Oct. 9, 2014

(65) Prior Publication Data

US 2015/0110533 A1 Apr. 23, 2015

(30) Foreign Application Priority Data

Oct. 18, 2013 (JP) ..... 2013-216934

(51) Int. Cl.
*G03G 15/20* (2006.01)

(52) U.S. Cl.
CPC .... *G03G 15/2053* (2013.01); *G03G 2215/2025* (2013.01); *G03G 2215/2035* (2013.01)

(58) Field of Classification Search
CPC ..... G03G 15/2017; G03G 15/2053; G03G 15/2064; G03G 2215/2022
See application file for complete search history.

(56) References Cited

U.S. PATENT DOCUMENTS

| | | | | |
|---|---|---|---|---|
| 6,795,678 | B2 * | 9/2004 | Yura et al. | 399/329 |
| 7,209,697 | B2 * | 4/2007 | Yoshida et al. | 399/329 |
| 2008/0107436 | A1 * | 5/2008 | Mikutsu | 399/67 |
| 2011/0206426 | A1 | 8/2011 | Komuro | |
| 2012/0251208 | A1 | 10/2012 | Hasegawa | |
| 2013/0223903 | A1 | 8/2013 | Matsuura | |

FOREIGN PATENT DOCUMENTS

| | | | |
|---|---|---|---|
| EP | 0957412 | A2 | 11/1999 |
| JP | 2003-302852 | A | 10/2003 |
| JP | 2009-116141 | A | 5/2009 |

OTHER PUBLICATIONS

The extended European search report issued by the European Patent Office on Dec. 5, 2014, which corresponds to European Patent Application No. 14188080.7-1560 and is related to U.S. Appl. No. 14/510,346.

* cited by examiner

*Primary Examiner* — Gregory H Curran
(74) *Attorney, Agent, or Firm* — Studebaker & Brackett PC

(57) ABSTRACT

A fixing device includes a fixing belt, a pressuring member, a driving member and a slide contact member. The fixing belt is arranged rotatably. The pressuring member comes into pressure contact with the fixing belt to form a fixing nip and is arranged rotatably. The driving member is arranged so as to sandwich the fixing belt with the pressuring member and rotates the fixing belt. The slide contact member is arranged so as to sandwich the fixing belt with the pressuring member and comes into slide contact with the fixing belt. The fixing belt is engaged around the driving member and slide contact member with a state having looseness at least partially.

12 Claims, 6 Drawing Sheets

FIXING DEVICE AND IMAGE FORMING APPARATUS

INCORPORATION BY REFERENCE

This application is based on and claims the benefit of priority from Japanese Patent application No. 2013-216934 filed on Oct. 18, 2013, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine or a printer, includes a fixing device fixing a toner image onto a recording medium, such as a sheet. In the fixing device, a heat roller manner is widely applied. The heat roller manner is a manner making a pair of rollers come into pressure contact with each other to form a fixing nip. However, in order to sufficiently ensure a nip width (a width of a fixing nip) by the heat roller manner, it is necessary to enlarge an external diameter of each roller forming the fixing nip, and accordingly, heat capacity of components forming the fixing nip is increased. Because of this, a restoring time of the fixing device (a time until it is restored to a condition capable of fixing the toner image onto the sheet) is elongated to obstruct energy saving. If the external diameter of each roller forming the fixing nip is enlarged, a problem of deteriorating separability of the recording medium from each roller is brought.

Recently, in order to solve the above-mentioned problem, a belt fixing manner is applied. The belt fixing manner is a manner making a fixing belt and a pressuring member (e.g. a pressuring roller) come into pressure contact with each other to form a fixing nip. By applying the belt fixing manner, the nip width may be sufficiently ensured without enlarging external diameters of the fixing belt and pressuring member.

For example, there is a fixing device including a fixing belt arranged rotatably, a pressuring member coming into pressure contact with the fixing belt to form a fixing nip, a tensioning roller arranged to sandwich the fixing belt with the pressuring member and a slide contact member arranged to sandwich the fixing belt with the pressuring member.

In such a fixing device, the fixing belt is stretched across the tensioning roller and slide contact member and constant tension strength is applied to the whole area of the fixing belt. In such a condition, when the fixing belt is rotated, a sliding load of the fixing belt (a load required for sliding the fixing belt with respect to the slide contact member) becomes large. According to this, there is a possibility that the fixing belt is rapidly worn and durability of the fixing belt is deteriorated. If the fixing belt is rotated in a condition having the large sliding load, and is repeatedly bent in accordance with a shape of the slide contact member, there is a possibility of bringing damage of the fixing belt.

In order to rotate the fixing belt in a condition where the constant tension strength is applied to the whole area of the fixing belt, it is necessary to increase a nip pressure (a pressure of the fixing nip), and accordingly, drive torque of the fixing belt (torque required for rotating the fixing belt) is increased. If the nip pressure is increased as mentioned above, because each component of the fixing device must be enlarged in order to ensure strength withstanding the increased nip pressure, there is a possibility of bringing enlargement of the entire fixing device. In addition, if the nip pressure is increased as mentioned above, because the force shifting the fixing belt to one side in a longitudinal direction is strengthened, there is a possibility that an end part of the fixing belt interferes with other components and is damaged.

SUMMARY

In accordance with an embodiment of the present disclosure, a fixing device includes a fixing belt, a pressuring member, a driving member and a slide contact member. The fixing belt is arranged rotatably. The pressuring member comes into pressure contact with the fixing belt to form a fixing nip and is arranged rotatably. The driving member is arranged so as to sandwich the fixing belt with the pressuring member and rotates the fixing belt. The slide contact member is arranged so as to sandwich the fixing belt with the pressuring member and comes into slide contact with the fixing belt. The fixing belt is engaged around the driving member and slide contact member with a state having looseness at least partially.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
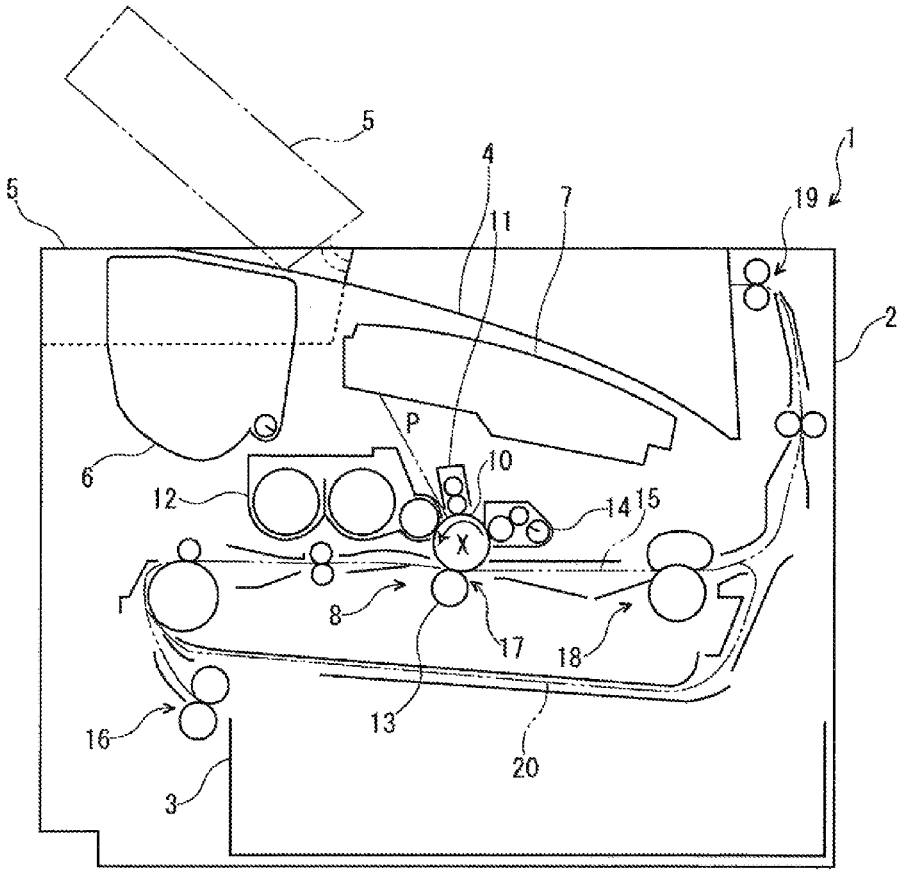
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, with reference to FIGS. 2 and 3, the fixing device 18 will be described in detail. Hereinafter, it will be described so that the front side of the fixing device 18 is positioned at the near side on FIG. 2, for convenience of explanation. An arrow Y in FIG. 2 indicates a conveying direction of the sheet. An arrow Fr in FIG. 3 indicates the front side of the fixing device 18.

Figure 2:
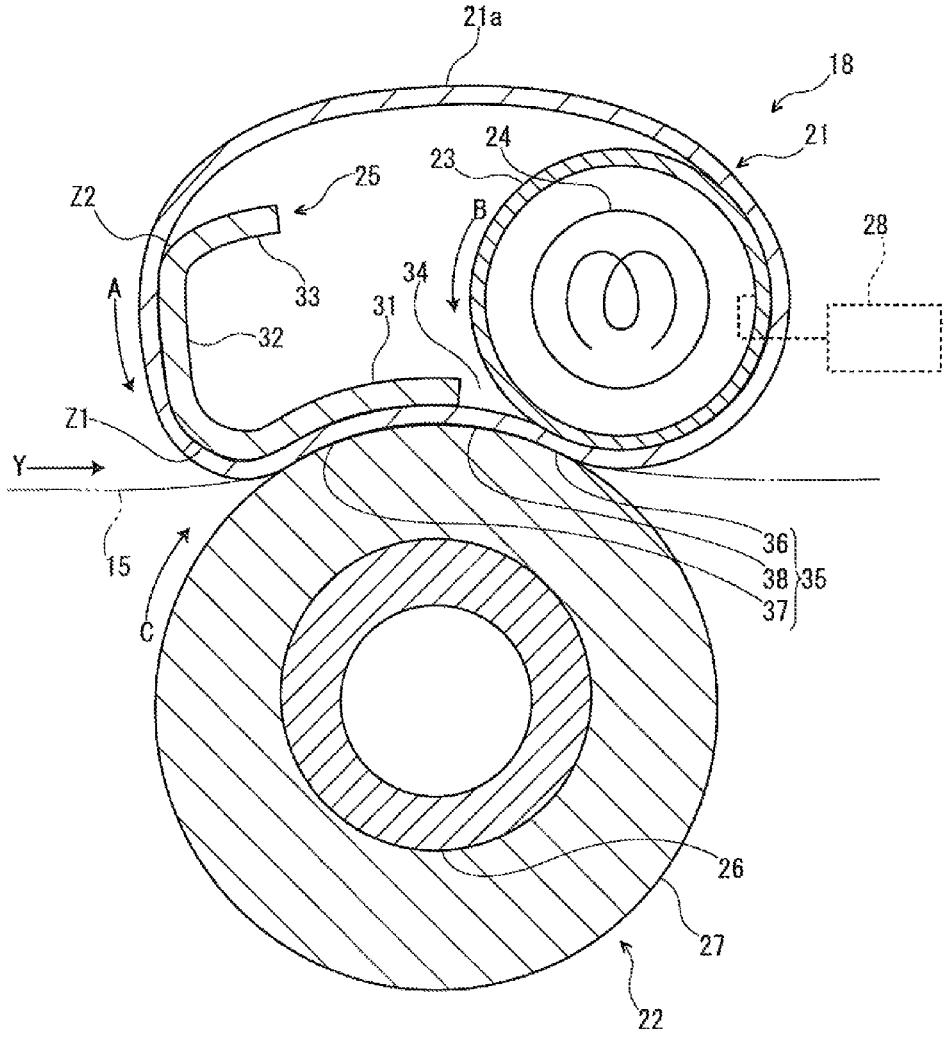
FIG. 2 is a sectional view showing a fixing device according to the first embodiment of the present disclosure.
Figure 3:
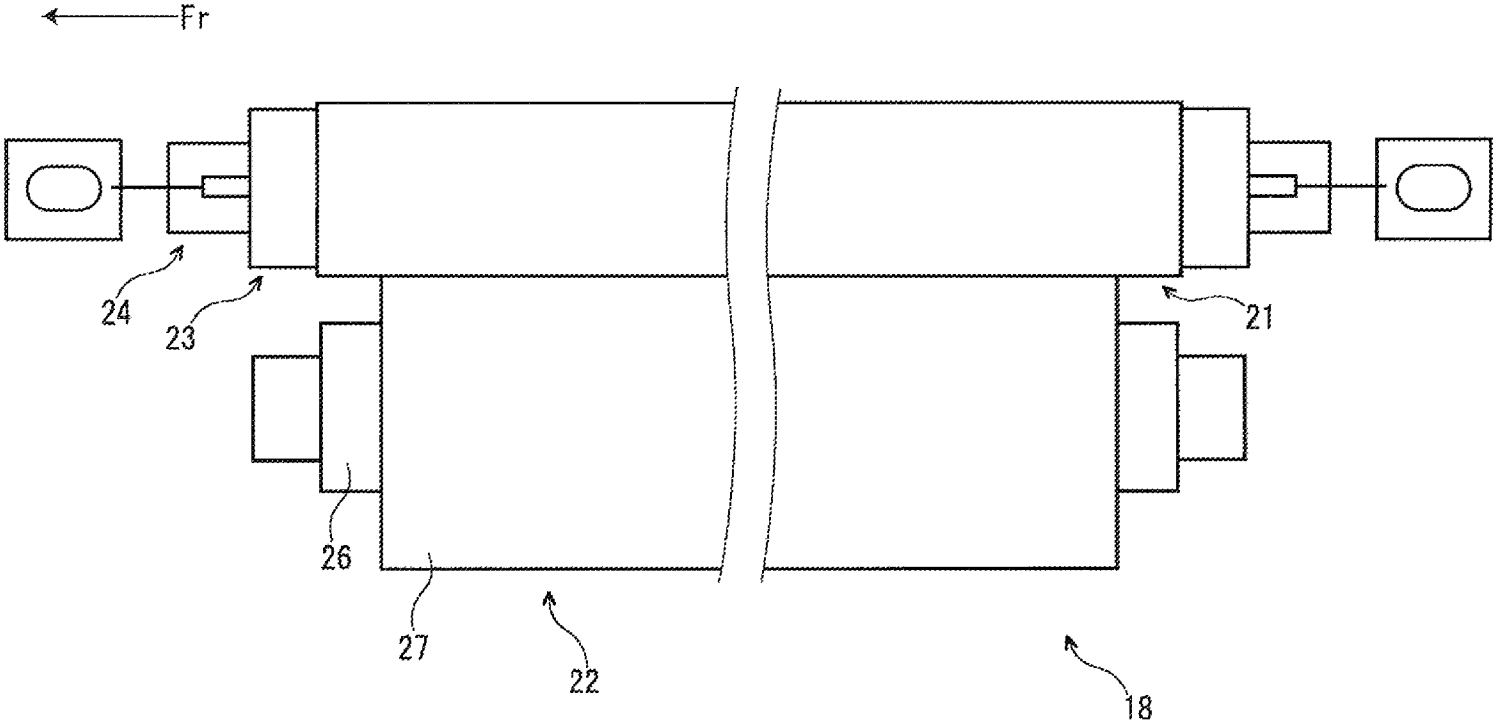
FIG. 3 is a right side view showing the fixing device according to the first embodiment of the present disclosure.

As shown in FIG. 2, the fixing device 18 includes a fixing belt 21, a pressuring roller 22 (a pressuring member), a driving roller 23 (a driving member), a heater (a heat source) and a slide contact member 25. The pressuring roller 22 is arranged below (outside) the fixing belt 21. The driving roller 23 is arranged inside the fixing belt 21. The heater 24 is contained in the driving roller 23. The slide contact member 25 is arranged inside the fixing belt 21 and at a left side (an upstream side in the conveying direction of the sheet) of the driving roller 23.

The fixing belt 21 is formed in a roughly cylindrical shape elongated in the forward and backward directions. The fixing belt 21 is rotatably arranged. An arrow A in FIG. 2 indicates a rotating direction of the fixing belt 21. The fixing belt 21 has flexibility and is endless in a circumference direction. The fixing belt 21 is engaged (wound) around the driving roller 23 and slide contact member 25 with a state having looseness at an upper part 21*a*. That is, the fixing belt 21 is not stretched across the driving roller 23 and slide contact member 25.

The fixing belt 21 is composed of, for example, a base material layer, an elastic layer provided around the base material layer and a release layer covering the elastic layer in order from the inside. The base material layer of the fixing belt 21 is made of, for example, resin, such as polyimide (PI), or metal, such as steel special use stainless (SUS) or nickel. The base material layer of the fixing belt 21 has, for example, a thickness of 15 μm-100 μm. The elastic layer of the fixing belt 21 is made of, for example, a silicone rubber. The elastic layer of the fixing belt 21 has, for example, a thickness of 50 μm-500 μm. The release layer of the fixing belt 21 is made of, for example, a perfluoro alkoxy alkane (PFA) tube. The release layer of the fixing belt 21 has, for example, a thickness of 15 μm-70 μm. Incidentally, each figure shows the respective layers (the base material layer, elastic layer and release layer) of the fixing belt 21 without distinguishing.

The pressuring roller 22 is formed in a roughly cylindrical shape elongated in the forward and backward directions. The pressuring roller 22 is rotatably arranged. The pressuring roller 22 faces to the fixing belt 21 and comes into pressure contact with the fixing belt 21.

The pressuring roller 22 is composed of, for example, a cylindrical core metal 26, an elastic layer 27 provided around the core metal 26 and a release layer (not shown) covering the elastic layer 27 in order from the inside. The core metal 26 of the pressuring roller 22 is made of, for example, metal, such as aluminum. The elastic layer 27 of the pressuring roller 22 is made of, for example, a foamed silicone rubber (a foamed body). The elastic layer 27 of the pressuring roller 22 has, for example, a thickness of 1 mm-10 mm. The release layer of the pressuring roller 22 is made of, for example, a PFA tube. The release layer of the pressuring roller 22 has, for example, a thickness of 15 μm-70 μm.

The driving roller 23 is made of, e.g. metal, such as aluminum, SUS or iron. The driving roller 23 has, for example, a thickness of 0.3 mm-0.7 mm. An external diameter of the driving roller 23 is smaller than an external diameter of the pressuring roller 22. The external diameter of the driving roller 23 is, preferably, 20%-80% of the external diameter of the pressuring roller 22. Both front and rear end parts of the driving roller 23 are extended to the outside of both front and rear end parts of the fixing belt 21 in the forward and backward directions (refer to FIG. 3).

As shown in FIG. 2, the driving roller 23 is connected to a drive source 28 composed of a motor or the like and it is configured so as to rotate the driving roller 23 by the drive source 28. The driving roller 23 is arranged so as to sandwich the fixing belt 21 with the pressuring roller 22.

The heater 24 is composed of, for example, a halogen heater or a carbon heater. The heater 24 is configured so as to generate heat by energization and to heat the driving roller 23.

The slide contact member 25 is composed of, for example, a base material layer and a surface layer covering the base material layer. The base material layer of the slide contact member 25 is made of, for example, metal, such as aluminum, SUS or iron, or heat resistant resin, such as liquid crystal polymer (LCP) or polyphenylene sulfide (PPS). The surface layer of the slide contact member 25 partially comes into slide contact with an inner circumference face of the fixing belt 21. The surface layer of the slide contact member 25 is, for example, made of fluorine coating or ceramic coating having heat resistance and slidability, or made of non-woven fabric. Incidentally, each figure shows the respective layers (the base material layer and surface layer) of the slide contact member 25 without distinguishing.

The slide contact member 25 has a first guide portion 31, a second guide portion 32 and a third guide portion 33. The second guide portion 32 is bent from a left end part (an end part at the upstream side in the conveying direction of the sheet) of the first guide portion 31 to an upper side (a side separating from the pressuring roller 22). The third guide portion 33 is bent from an upper end part (an end part at the side separating from the pressuring roller 22) of the second guide portion 32 to a right side (the downstream side in the conveying direction of the sheet). A boundary portion Z1 between the first guide portion 31 and second guide portion 32 and a boundary portion Z2 between the second guide portion 32 and third guide portion 33 are curved without an edge.

The first guide portion 31 comes into slide contact with the inner circumference face of the fixing belt 21. The first guide portion 31 is arranged so as to sandwich the fixing belt 21 with the pressuring roller 22. The first guide portion 31 is curved in an arc shape along an outer circumference face of the pressuring roller 22. A right end part (an end part at the downstream side in the conveying direction of the sheet) of the first guide portion 31 faces to an outer circumference face of the driving roller 23 at a distance 34.

The second guide portion 32 is extended in a straight line shape roughly along upward and downward directions (to be exact, a direction inclined to the slightly left side as going upwardly). The second guide portion 32 comes into slide contact with an inner circumference face of the fixing belt 21. The third guide portion 33 has a length shorter than those of the first guide portion 31 and second guide portion 32. The third guide portion 33 is separated from the inner circumference face of the fixing belt 21.

As shown in FIG. 2, in a pressure contact portion between the fixing belt 21 and pressuring roller 22, a fixing nip 35 is formed. The force applied to the fixing nip 35 is set to 100N or less as a whole.

The fixing nip 35 has a first nip portion 36, a second nip portion 37 arranged at the left side of the first nip portion 36 and a third nip portion 38 arranged between the first nip portion 36 and second nip portion 37.

The first nip portion 36 is formed in a part where the pressuring roller 22 and driving roller 23 sandwich the fixing belt 21. The first nip portion 36 is backed up from the inside of the fixing belt 21 by the driving roller 23.

The second nip portion 37 is formed in a part where the pressuring roller 22 and first guide portion 31 of the slide contact member 25 sandwich the fixing belt 21. The second nip portion 37 is backed up from the inside of the fixing belt 21 by the first guide portion 31 of the slide contact member 25. The second nip portion 37 is arranged at the upstream side from the first nip portion 36 in the rotating direction (refer to the arrow A in FIG. 2) of the fixing belt 21. The first nip portion 36 and second nip portion 37 are configured so that the sum total of the force applied to the second nip portion 37 is larger than the sum total of the force applied to the first nip portion 36. That is, the force sandwiching the fixing belt 21 by the pressuring roller 22 and first guide portion 31 of the slide contact member 25 is larger than the force sandwiching the fixing belt 21 by the pressuring roller 22 and driving roller 23.

The third nip portion 38 is arranged at a position corresponding to the distance 34. Therefore, the third nip portion 38 is not backed up from the inside of the fixing belt 21.

In the fixing device 18 configured as mentioned above, in order to fix the toner image onto the sheet, as indicated by an arrow B in FIG. 2, the drive source 28 works to rotate the driving roller 23. According to this, as indicated by arrows A and C in FIG. 2, the fixing belt and pressuring roller 22 are co-rotated with the rotation of the driving roller 23. That is, the driving roller 23 rotates the fixing belt 21 and pressuring roller 22. At this time, the fixing belt 21 is rotated from a side of the slide contact member 25 to a side of the driving roller 23 in a state of being sandwiched by the pressuring roller 22 and driving roller 23.

Moreover, in order to fix the toner image onto the sheet, the heater 24 is activated (lighted). When the heater 24 is thus activated, the driving roller 23 is heated from the inside by the heater 24 and the fixing belt 21 is heated from the inside by heat conduction from the driving roller 23. In such a condition, when the sheet is passed through the fixing nip 35, the toner image is heated and melted, and then, fixed onto the sheet.

In the embodiment, as mentioned above, the fixing belt 21 is engaged around the driving roller 23 and slide contact member 25 with the state having the looseness at the upper part 21*a* (an opposite portion to a portion forming the fixing nip 35). Therefore, it is possible to decrease a sliding load of the fixing belt 21 as compared with a case where constant tension strength is applied to the whole area of the fixing belt 21. According to this, it is possible to restrain wear of the fixing belt 21 and to improve durability of the fixing belt 21. Even if the fixing belt 21 is repeatedly bent in accordance with a shape of the slide contact member 25 accompanying to the rotation of the fixing belt 21, the fixing belt 21 is hardly damaged.

Moreover, since the fixing belt 21 is engaged around the driving roller 23 and slide contact member 25 with the state having the looseness at the upper part 21*a*, it is possible to sufficiently ensure a nip width without increasing a nip pressure. According to this, it is possible to decrease drive torque of the fixing belt 21. In addition, since it is unnecessary to increase the nip pressure as mentioned above, it is unnecessary to enlarge each component of the fixing device 18 in order to make the component have strength withstanding the increased nip pressure. Therefore, it is possible to achieve minimization of the entire fixing device 18 and to produce the fixing device 18 at low cost. By preventing the nip pressure from being increased, since it is possible to weaken the force shifting the fixing belt 21 to one side in forward and backward directions, it is possible to prevent an end part of the fixing belt 21 from coming into contact with other components and from being damaged.

Since the fixing belt 21 is sandwiched between the pressuring roller 22 and driving roller 23, it is possible to securely conduct drive force of the driving roller 23 to the fixing belt 21. Therefore, even if the upper part 21*a* of the fixing belt 21 is loosened, it is possible to stably rotate the fixing belt 21.

By sandwiching the fixing belt 21 between the pressuring roller 22 and driving roller 23 and between the pressuring roller 22 and first guide portion 31 of the slide contact member 25, it is possible to improve adhesion between the fixing belt 21 and pressuring roller 22 in the fixing nip 35. Therefore, it is possible to ensure suitable nip pressure and to restrain image deterioration caused by fixing failure.

During rotating the fixing belt 21, in the first nip portion 36, the force rotating the fixing belt 21 acts from the driving roller 23 to the fixing belt 21. On the other hand, in the second nip portion 37, the force holding the fixing belt 21 in a stopping state acts from the first guide portion 31 of the slide contact member 25 to the fixing belt 21. Therefore, by arranging the second nip portion 37 at the upstream side from the first nip portion 36 in the rotating direction of the fixing belt 21, in the third nip portion 38 formed between the first nip portion 36 and second nip portion 37, constant tension strength is applied to the fixing belt 21. Accordingly, it is possible to restrain the fixing belt 21 from being loosened at the third nip portion 38 and to prevent image deterioration caused by fixing failure.

The sum total of the force applied to the second nip portion 37 is larger than the sum total of the force applied to the first nip portion 36. Therefore, it is possible to securely fix the toner image onto the sheet at the second nip portion 37 and to more efficiently prevent image deterioration caused by fixing failure.

It is configured so that, when the driving roller 23 is rotated by the drive source 28, the fixing belt 21 and pressuring roller 22 are co-rotated with the rotation of the driving roller 23. By applying such a configuration, it is possible to stabilize rotation speed of the fixing belt 21 and pressuring roller 22.

By curving the first guide portion 31 of the slide contact member 25 in the arc shape along the outer circumference face of the pressuring roller 22, it is easy to deform the fixing belt 21 to a shape along the outer circumference face of the pressuring roller 22 and it is possible to ensure wide nip width. According to this, it is possible to securely fix the toner image onto the sheet at the fixing nip 35. In addition, by curving the boundary portion Z1 between the first guide portion 31 and second guide portion 32 and the boundary portion Z2 between the second guide portion 32 and third guide portion 33, it is possible to restrain catching between the fixing belt 21 and the slide contact member 25.

The pressuring roller 22 has the elastic layer 27 made of the foamed silicone rubber (the foamed body). By applying such a configuration, it is possible to decrease heat capacity of the pressuring roller 22 as compared with a case where the elastic layer 27 of the pressuring roller is made of solid material (solid wood material). Therefore, it is possible to reduce heat quantity taken by the pressuring roller 22 and to more quickly heat the fixing belt 21.

In the embodiment, since the external diameter of the driving roller 23 is smaller than the external diameter of the pressuring roller 22, it is possible to reduce heat capacity of the driving roller 23 and to heat the driving roller 23 at a short time.

Since the fixing nip 35 is formed by using the fixing belt 21, it is possible to ensure sufficient nip width without enlarging external diameters of the fixing belt 21 and pressuring roller 22. Therefore, it is possible to reduce heat capacity of components constituting the fixing nip 35 and to achieve energy saving and shortening of restoring time of the fixing device 18. Further, by reducing the external diameter of the fixing belt 21, it is possible to easily separate the sheet from the fixing belt 21.

The surface layer of the slide contact member 25 is made of the fluorine coating or the ceramic coating having the heat resistance and the slidability, or made of the non-woven fabric. Therefore, it is possible to decrease the sliding load of the fixing belt 21, to decrease the drive torque of the fixing belt 21 and to restrain the wear of the fixing belt 21.

Although, in the embodiment, a case where the fixing belt 21 is composed of the base material layer, elastic layer and release layer was described, in another embodiment, the fixing belt 21 may be composed of a base material layer and a release layer. That is, the fixing belt 21 may be made without the elastic layer. In such a case where the elastic layer is not arranged in the fixing belt 21, for example, instead of the PFA tube with a thickness of 15 μm-70 μm, fluorine coating with a thickness of 15 μm-70 μm may be used as the release layer of the fixing belt 21.

In the embodiment, a case where the elastic layer of the pressuring roller 22 is made of the foamed silicone rubber (the foamed body) was described. On the other hand, in another embodiment, the elastic layer 27 of the pressuring roller 22 may be made of a solid rubber (solid material).

Although, in the embodiment, a case of using the heater 24 composed of the halogen heater or the carbon heater as the heat source was described, in another embodiment, a ceramic heater, an IH (Induction Heating) coil or the like may be used as the heat source.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Second Embodiment

Next, a fixing device 41 according to a second embodiment of the present disclosure will be described with reference to FIGS. 4 and 5. Hereinafter, it will be described so that the front side of the fixing device 41 is positioned at the near side on FIG. 4, for convenience of explanation. An arrow Y in FIG. 4 indicates the conveying direction of the sheet. An arrow Fr in FIG. 5 indicates the front side of the fixing device 41. Incidentally, other components except for winding rollers 42 (winding members) have similar or corresponding configurations to the first embodiment, and therefore, the other components will be denoted by the same reference numerals in the figures and their explanation will be omitted.

Figure 4:
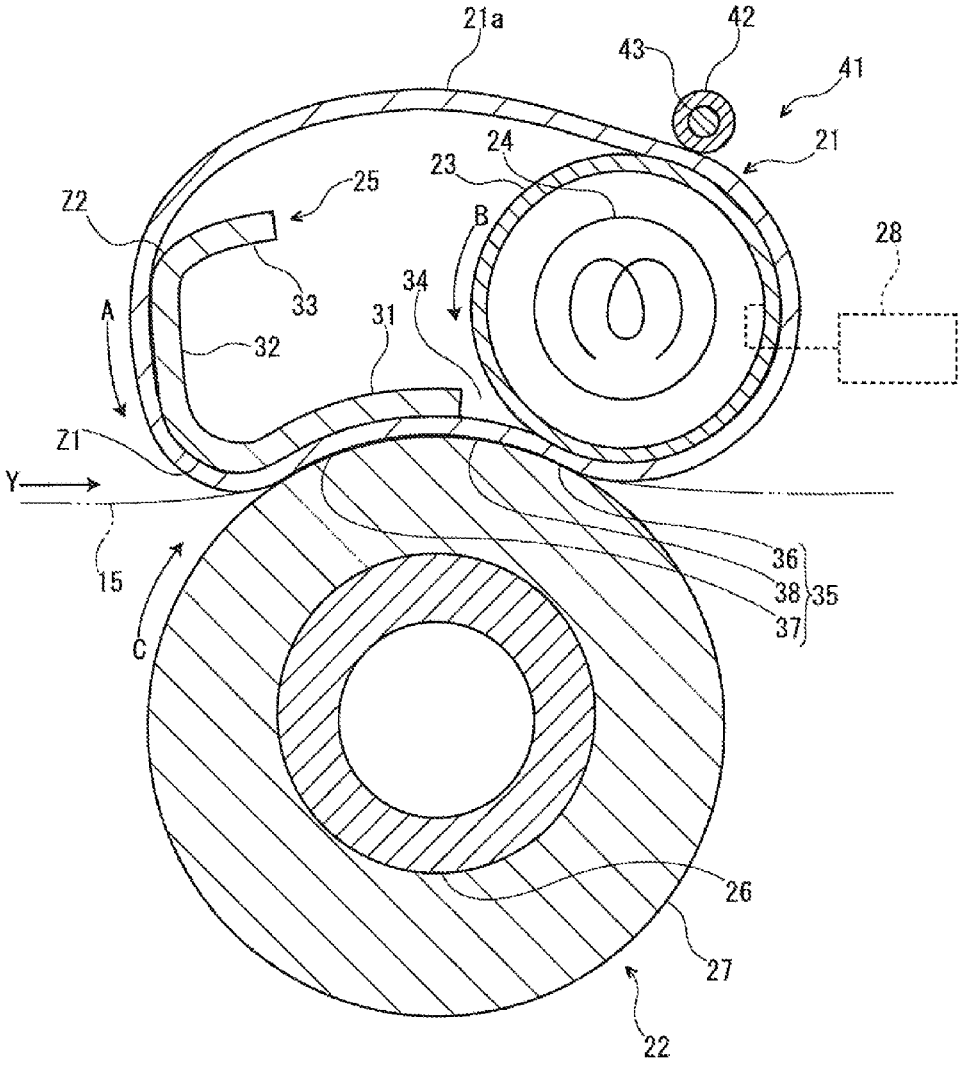
FIG. 4 is a sectional view showing a fixing device according to a second embodiment of the present disclosure.

As shown in FIG. 4, the winding rollers 42 are located at an opposite side to the pressuring roller 22 across the driving roller 23. The winding rollers 42 are arranged so as to sandwich the fixing belt 21 with the driving roller 23. The winding rollers 42 are rotatably arranged around a roller shaft 43 extending in the forward and backward directions.

Figure 5:
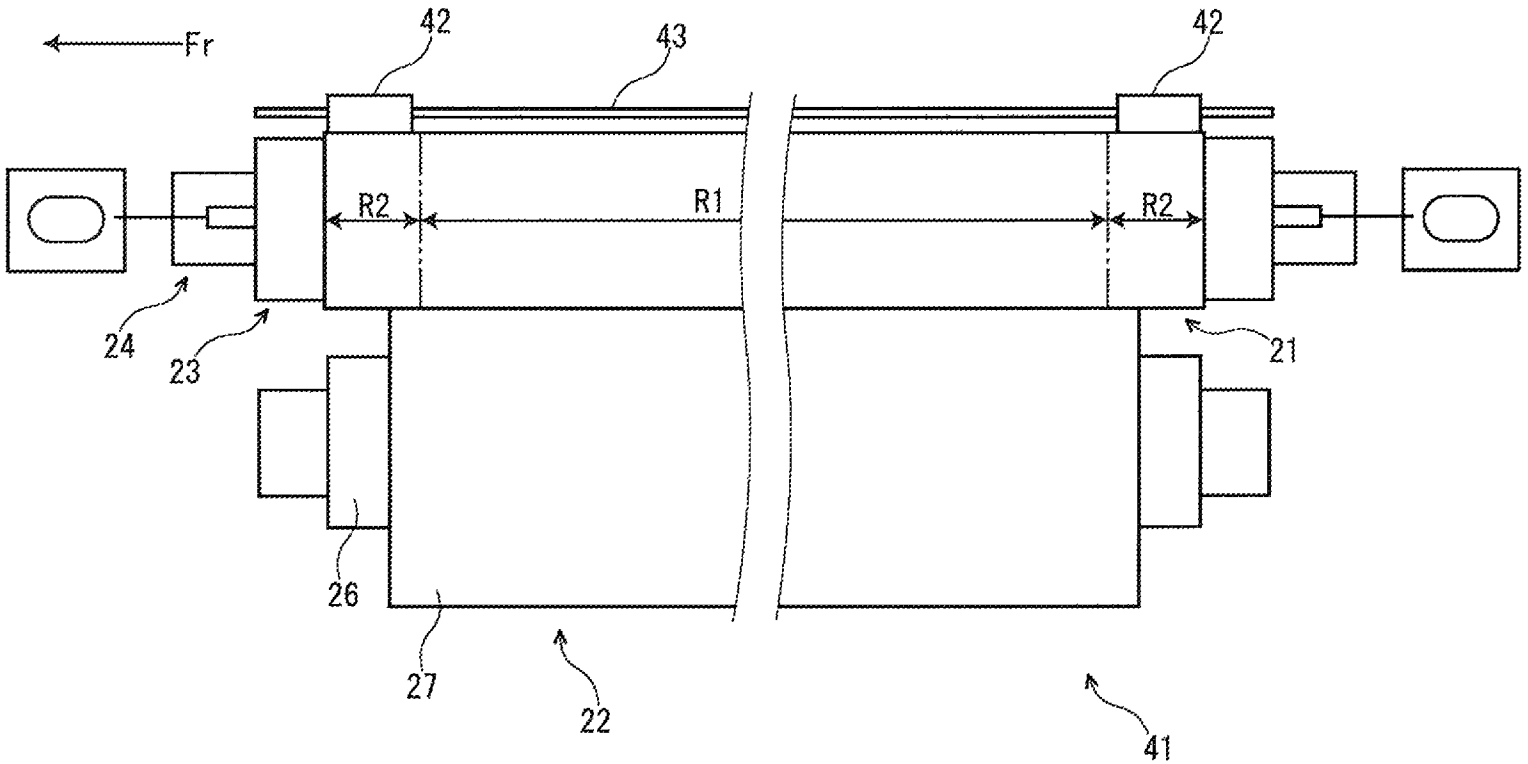
FIG. 5 is a right side view showing the fixing device according to the second embodiment of the present disclosure.

As shown in FIG. 5, the fixing belt 21 has a sheet passing region (a recording medium passing region) R1, on which the sheet is passed, and sheet non-passing regions (recording medium non-passing regions) R2, on which the sheet is not passed, arranged both front and rear sides of the sheet passing region R1 (outside the sheet passing region R1). Each winding roller 42 does not come into contact with the sheet passing region R1 of the fixing belt 21, but comes into contact with the sheet non-passing regions R2 of the fixing belt 21.

Each winding roller 42 is composed of, for example, a cylindrical core metal and a surface layer covering a surface of the core metal. The core metal of each winding roller 42 is made of, for example, metal, such as aluminum, SUS or iron. The surface layer of each winding roller 42 is made of, for example, fluorine resin coating or fluorine resin tube.

By arranging each winding roller 42 as mentioned above, it is possible to make the fixing belt 21 securely come into contact with the driving roller 23 from a lower side (an area of a side of the pressuring roller 22) of the driving roller 23 to an upper side (an area of an opposite side to the pressuring roller 22) of the driving roller 23. According to this, it is possible to quickly heat the fixing belt 21 by the heat conduction from the driving roller 23, to shorten the restoring time of the fixing device 41 and to achieve energy saving.

Each winding roller 42 comes into contact with the sheet non-passing regions R2 of the fixing belt 21. Therefore, it is possible to prevent heat of the sheet passing region R1 from being taken by each winding roller 42.

Figure 6:
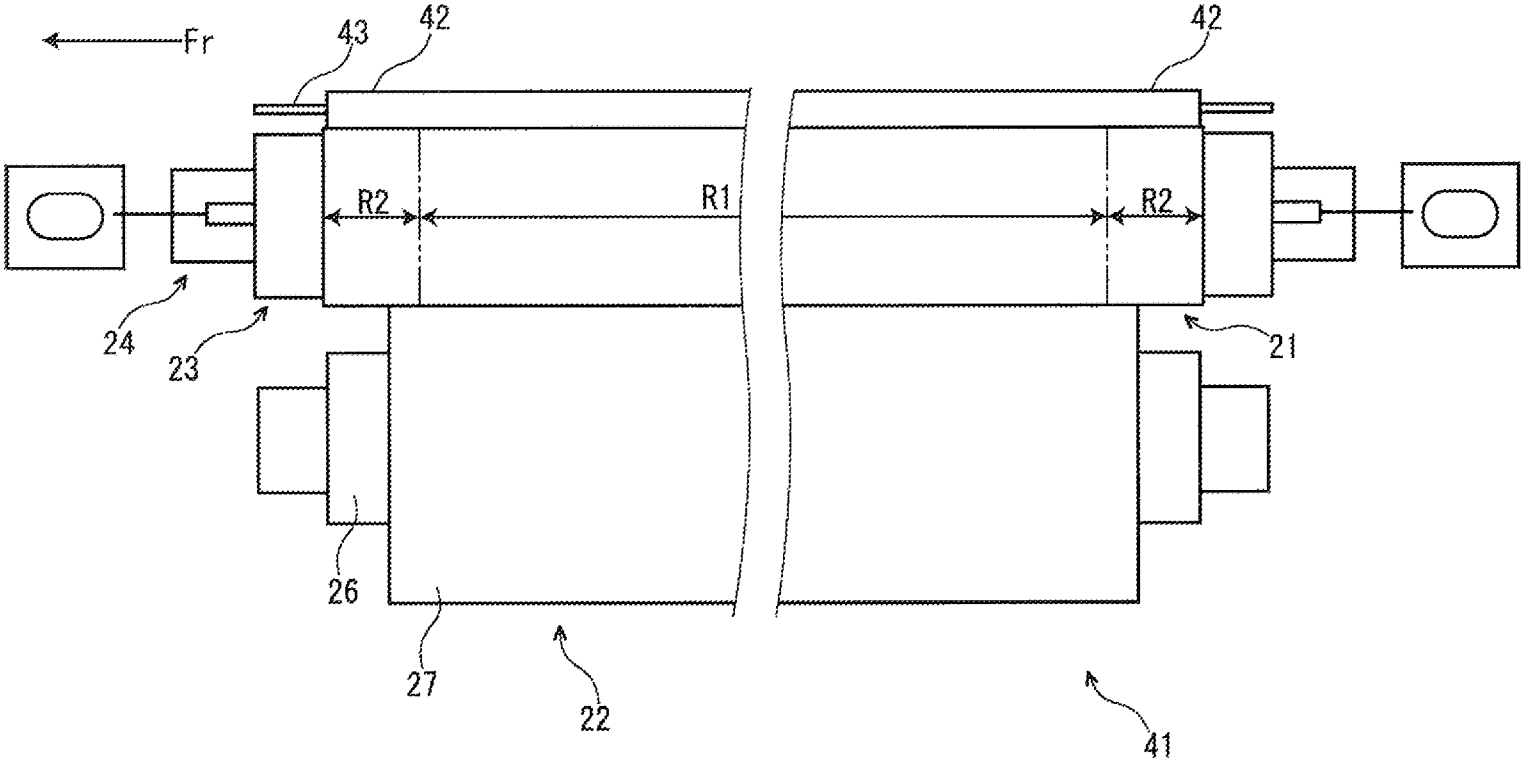
FIG. 6 is a right side view showing a fixing device according to another different embodiment of the present disclosure.

In the embodiment, a case where each winding roller 42 comes into contact with the sheet non-passing regions R2 of the fixing belt 21 was described. On the other hand, in another different embodiment, as shown in FIG. 6, the winding roller 42 may come into contact with the sheet passing region R1 and sheet non-passing regions R2 of the fixing belt 21 (roughly whole area of the fixing belt 21). By applying such a configuration, it is possible to make both the sheet passing region R1 and sheet non-passing regions R2 of the fixing belt 21 securely come into contact with the driving roller 23 and to improve heat conduction efficiency from the driving roller 23 to the fixing belt 21.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member coming into pressure contact with the fixing belt to form a fixing nip and arranged rotatably;

a driving member arranged so as to sandwich the fixing belt with the pressuring member and rotating the fixing belt; and a slide contact member arranged so as to sandwich the fixing belt with the pressuring member and coming into slide contact with the fixing belt;

a heat source contained in the driving member; and a winding member located at an opposite side to the pressuring member across the driving member and arranged so as to sandwich the fixing belt with the driving member, wherein the fixing belt is engaged around the driving member and slide contact member with a state having looseness at least partially.

2. The fixing device according to claim 1, wherein the fixing nip has:

a first nip portion formed in a part where the pressuring member and driving member sandwich the fixing belt;

a second nip portion formed in a part where the pressuring member and slide contact member sandwich the fixing belt; and a third nip portion formed between the first nip portion and second nip portion, the second nip portion is arranged at an upstream side from the first nip portion in a rotating direction of the fixing belt.

3. The fixing device according to claim 2, wherein the sum total of the force applied to the second nip portion is larger than the sum total of the force applied to the first nip portion.

4. The fixing device according to claim 1, further comprising:

a drive source connected to the driving member, wherein the fixing belt and pressuring member are co-rotated with rotation of the driving member, when the driving member is rotated by the drive source.

5. The fixing device according to claim 1, wherein the slide contact member has:

a first guide portion arranged so as to sandwich the fixing belt with the pressuring member and curved in an arc shape along an outer circumference face of the pressuring member;

a second guide portion bent from an end part at an upstream side of the first guide portion in a conveying direction of a recording medium to a side separating from the pressuring member; and a third guide portion bent from an end part at a side separating from the pressuring member of the second guide portion to a downstream side in the conveying direction of the recording medium, a boundary portion between the first guide portion and second guide portion and a boundary portion between the second guide portion and third guide portion are curved.

6. The fixing device according to claim 5, wherein an end part at the downstream side of the first guide portion in the conveying direction of the recording medium faces to an outer circumference face of the driving member at a distance.

7. The fixing device according to claim 5, wherein the third guide portion is separated from an inner circumference face of the fixing belt.

8. The fixing device according to claim 1, wherein the pressuring member has an elastic layer made of a foamed body.

9. The fixing device according to claim 1, wherein the fixing belt has:

a recording medium passing region, on which the recording medium is passed; and a recording medium non-passing region arranged outside the recording medium passing region, the winding member does not come into contact with the recording medium passing region and comes into contact with the recording medium non-passing region.

10. The fixing device according to claim 1, wherein the fixing belt has:

a recording medium passing region, on which the recording medium is passed; and a recording medium non-passing region arranged outside the recording medium passing region, the winding member comes into contact with the recording medium passing region and recording medium non-passing region.

11. The fixing device according to claim 1, wherein the fixing belt is engaged around the driving member and slide contact member with a state having looseness at an opposite portion to a portion forming the fixing nip.

12. An image forming apparatus comprising:

the fixing device according to claim 1.

* * * * *